United States Patent [19]

Van Sloun

[11] Patent Number: 4,926,750

[45] Date of Patent: May 22, 1990

[54] SAFETY LOCKING PULL RING

[75] Inventor: Peter H. Van Sloun, Hopkins, Minn.

[73] Assignee: Honeywell Inc., Minneapolis, Minn.

[21] Appl. No.: 256,444

[22] Filed: Oct. 12, 1988

[51] Int. Cl.[5] ..... F42C 15/22

[52] U.S. Cl. ..... 102/261; 102/486; 403/322

[58] Field of Search ..... 403/322; 411/347; 102/260, 261, 486

[56] References Cited

U.S. PATENT DOCUMENTS 3,289,521 12/1966 Van Sloun ..... 403/315
4,474,112 10/1984 Cooksey et al. ..... 102/260
4,487,128 12/1984 Van Sloun ..... 102/261

*Primary Examiner*—David H. Brown
*Attorney, Agent, or Firm*—Roger W. Jensen

[57] ABSTRACT

A safety, locking, pull ring for a munition which must be deformed and simultaneously rotated from a protecting locking recess and which must then be rotated 180 degrees from the recessed position in order to free one end of a pivotably attached bar. The bar must then be rotated 180 degrees, using the ring as a handle, to expose both a safety wire which must be removed to arm the munition, and expose an indicator light, which indicates the safe or unsafe condition of the munition, and finally to crush an ampule to release electrolyte to energize a battery which powers the munition electronic circuitry.

12 Claims, 5 Drawing Sheets

SAFETY LOCKING PULL RING

FIELD OF THE INVENTION

This invention is utilized as a safety device to prevent premature detonation and explosion in portable explosive devices such as hand grenades, pocket mines and other munitions.

REFERENCE TO RELATED APPLICATIONS

This application is related to the following commonly assigned applications filed concurrently herewith:

| Title | Ser. No |
|---|---|
| Self-Sterilizing Safe-Arm Device with Arm/Fire Feature | 256,445 |
| Selectable Lightweight Attack Munition | 256,437 |

BACKGROUND OF THE INVENTION

Present applicant's earlier U.S. Pat. No. 3,289,521 patented Dec. 6, 1966 and No. 4,487,128 patented Dec. 11, 1984 are the pertinent examples of prior art in this field.

This invention is a portion of an overall portable munition system and cooperates with other elements which are the subject of the related applications given above. This invention is utilized to provide a safety device to prevent accidental or premature detonation and explosion of the munition while elements of the other inventions cooperate with the action of this invention to provide a complete munition. These related inventions when combined with this invention explain the entire operation of the munition.

SUMMARY OF THE INVENTION

A recessed safety,locking,pull ring in a side face of the munition holds one end of a bar in place within a groove in the top of a munition perpendicular to the side face. This ring provides the primary safety device for the munition in that the end of the bar held by the ring must be released and the bar rotated about its opposite end to permit removing a safety wire in order to arm the munition. An ampule containing electrolyte is also crushed by the full rotation of the bar which energizes a battery to power electronics for the munition control circuitry.

The ring is flexible and is oval shaped and fits in a recess which matches this oval shape. The ring is pivotably connected to the bar. The opposite end of the bar pivots about a rod attached to the top of the munition. A pair of opposed locking lugs extending perpendicularly from the ring at its base engage a rectangular recess in the plane of the ring recess when the ring is secured in its recess. These locking lugs prevent lifting the bar while the lugs are engaged and the lugs are arranged such that they will not release until the ring is rotated 180 degrees from its recessed position.

The end of the ring opposite the pin is secured in the recess by two locking tabs near the end of the ring which extend over the recess in the plane of the side face. The recess for the ring has a centered gap between these locking tabs which extends to a perpendicular surface opposite the top surface which contains the bar. This gap allows the user to press on the end of the ring. The ring is reinforced between the gap area which results in this portion of the deformed ring having a generally fixed configuration which will clear the locking tabs when forced upward. The upper portion of the inner wall of the ring recess is shaped to hold the undeformed ring while the lower portion of the inner wall and the outer wall of the upper portion are shaped to accommodate the deformed ring shape. When the freed ring is rotated 180 degrees from the recessed position the lugs extending from the ring adjacent the bar pivot clear of the rectangular lug recess which permits lifting the end of the bar using the ring as a handle. The pivoted end of the bar is cam shaped and this cam crushes an ampule which is mounted under the pivot point when the bar is rotated 180degrees. Electrolyte held by the ampule is released to energize a battery to power electronic circuitry which controls the munition. Lifting the bar also exposes a safety wire and an indicator light which are located in the groove under the bar, to allow observing the light to determine whether the status of the electronic controls is safe, and to permit removing the safety wire in order to arm the munition.

This locking ring provides excellent safety to prevent accidentally arming this munition in that the ring must first be released from its recess, which can only be accomplished by first deforming the ring, and then simultaneously lifting the ring out of the recess while still in this deformed shape. Even after removing the ring from the recess it still must be rotated a full 180 degrees in order to free the locking lugs extending from the pivoted end of the ring and only then can the bar be rotated using the ring as a handle as the first step in arming the munition. Only after the bar is rotated is the battery for the munition electronic circuitry energized, the status light exposed to show whether arming should proceed, and the safety wire, which must be removed to arm the apparatus, released.

DETAILED DESCRIPTION OF THE PREFERRED EMBODIMENT

Figure 1:
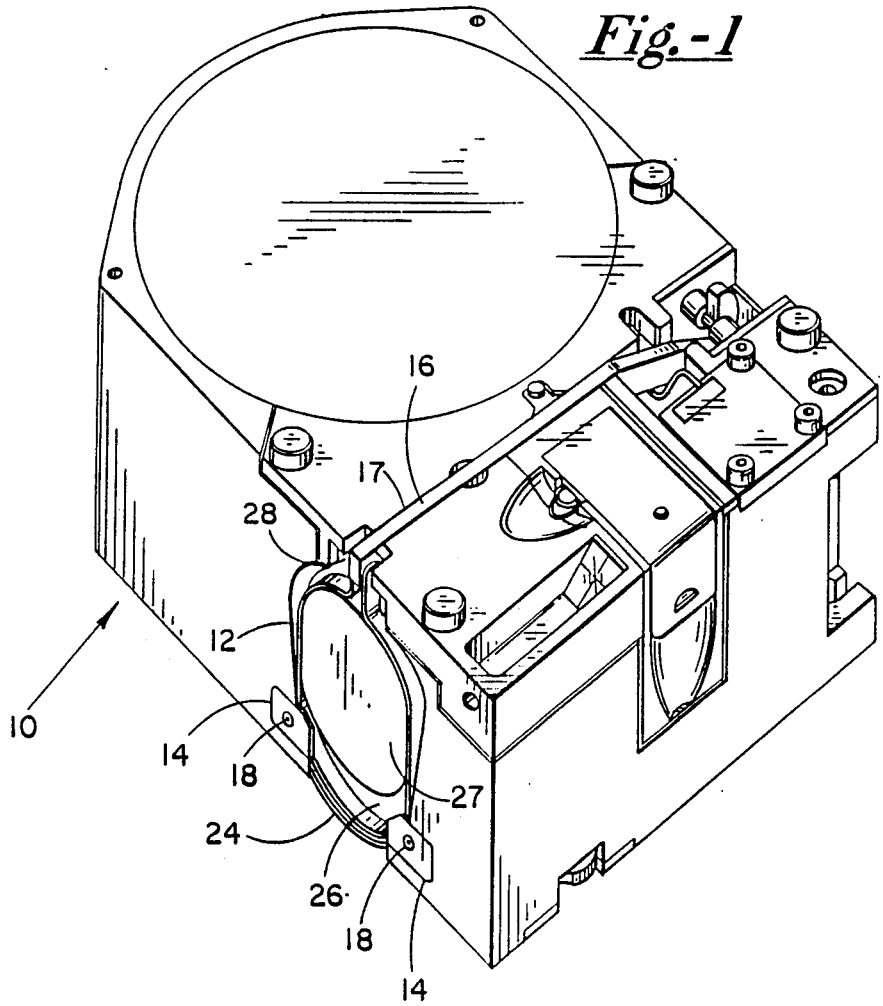
FIG. 1 is an isometric view of the munition.
Figure 2:
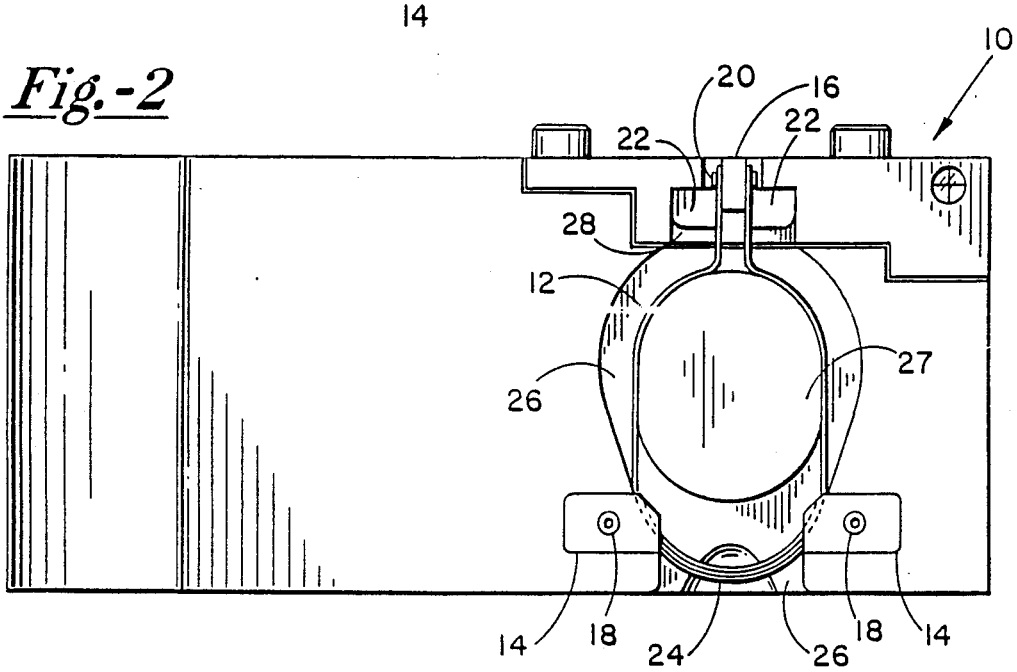
FIG. 2 is a side view of the munition.

Munition 10 is shown in FIG. 1 with locking pull ring 12 held in place by tabs 14 which holds the end of bar 16 within a groove 17 in the top surface. FIG. 2 shows tabs 14 secured by screws 18 extending through matching holes in the tabs into mating tapped holes in the side of the munition 10. Pin 20 pivotably secures ring 12 to the end of bar 16 through aligned holes in the ring and bar. Locking lugs 22 extend outwardly from ring 12 which are integral with the ring. Ring 12 is fashioned of spring steel and the end portion of the ring 24 between lugs 14 consists of three layers of spring steel, the purpose of which will be discussed later.

Figure 3:
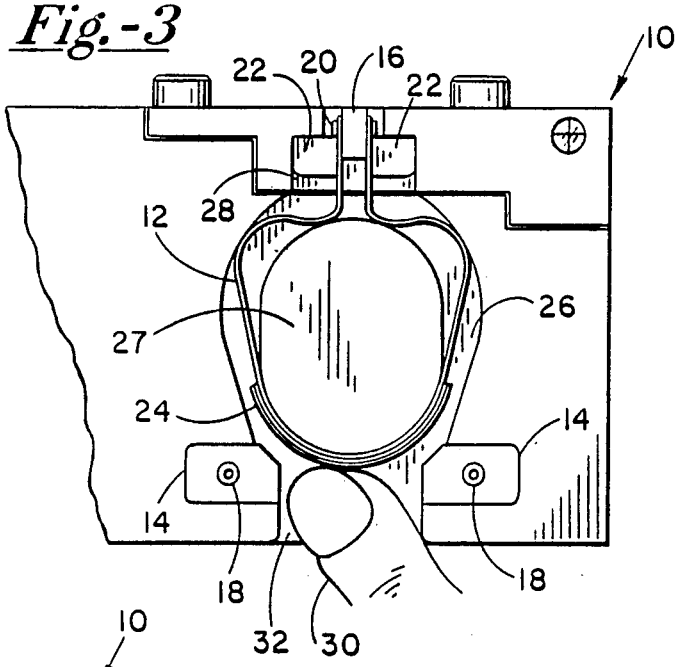
FIG. 3 is a portion of FIG. 2 showing the ring being depressed.
Figure 4:
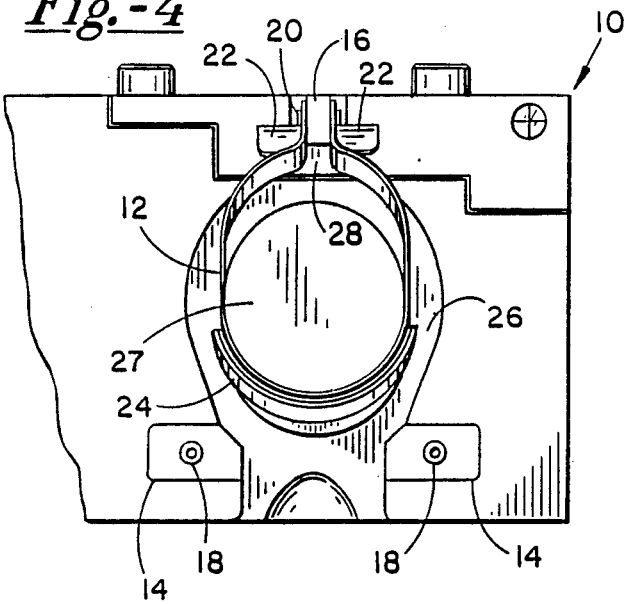
FIG. 4 is the same portion of FIG. 2 after the ring is lifted out of the recess.

Locking lugs 22 which extend outwardly from ring 12 engage the upper surface of lug recess 28 which prevents the ring from being moved upwardly. This locking action of lugs 22 and holding action of tabs 14 can be seen more clearly in FIG. 8. Here ring 12 is recessed within ring recess 26. Tabs 14 over the lower end of ring 12 hold the ring in this position within recess 26. Land 27 in the center of ring recess 26 is adjacent to ring 12 and protects the ring against anything sliding along the surface which would otherwise tend to remove the ring from the recess. Locking lugs 22 which extend perpendicularly outwardly from the base of ring 12 are located within lug recess 28 which prevents vertical motion of the ring. A safety wire 36 is held under bar 16 with the free end secured in a hole 15 which extends inward from a notch in the lower side of the bar. In FIG. 2 it can be seen that ring 12 fits closely about the upper portion of land 27 and bears against the outer walls of ring recess 26 adjacent tabs 14. In FIG. 3 ring 12 is being deformed by a thumb 30 pressing on the multilayered end portion of ring 24 through a gap 32 between tabs 14. This deformation changes the shape of ring 12 to clear tabs 14 since the end portion of ring 24 essentially retains its shape because it is multilayered and the ring is therefore deformed primarily in its upper single layer which results in the lower edge moving upward and clearing the tabs. The outer wall of ring recess 26 expanded in shape and the inner wall of the lower edge are shaped to permit this deformation. While ring 12 is still in this deformed shape to clear tabs 14, the ring is rotated about pin 20 until it is clear of ring recess 26 and the pressure on the ring can be released as shown in FIG. 4. Lugs 22 have rotated as parts of ring 12 but are still located within lug recess 28 which prevents the ring 12 from being moved upward.

Figure 9:
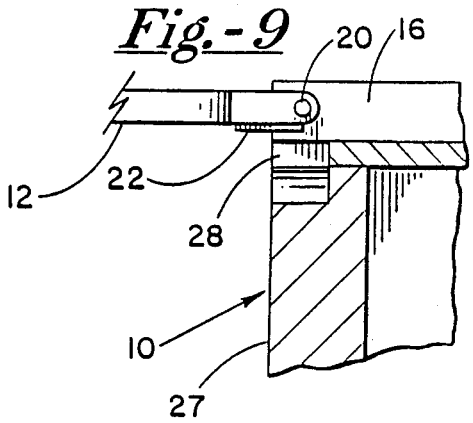
FIG. 9 is a detailed fragment showing the ring in cross-section rotated 90 degrees from the recess.

Once ring 12 is free of recess 26 it can be used as a handle to rotate the ring and as a handle to rotate bar 16 as shown in subsequent steps. In FIG. 9 ring 12 is shown rotated approximately 90 degrees from the initial secured position. Here lugs 22 which extend from the lower edge of ring 12 in this position are still partially within lug recess 28 which prevents moving the end of bar 16 vertically.

Figure 5:
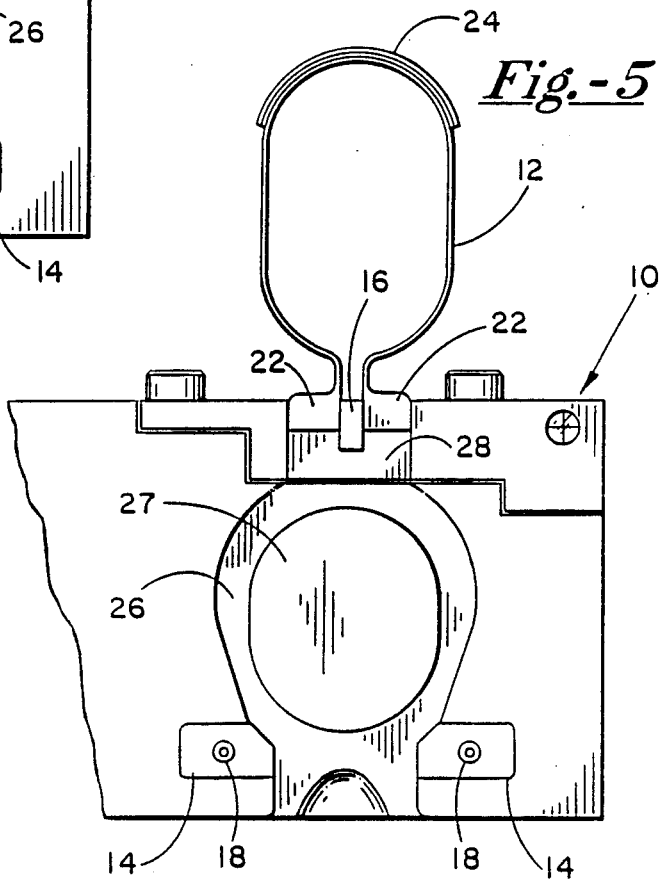
FIG. 5 is the same portion of FIG. 2 showing the ring rotated 180 degrees from the recess.
Figure 6:
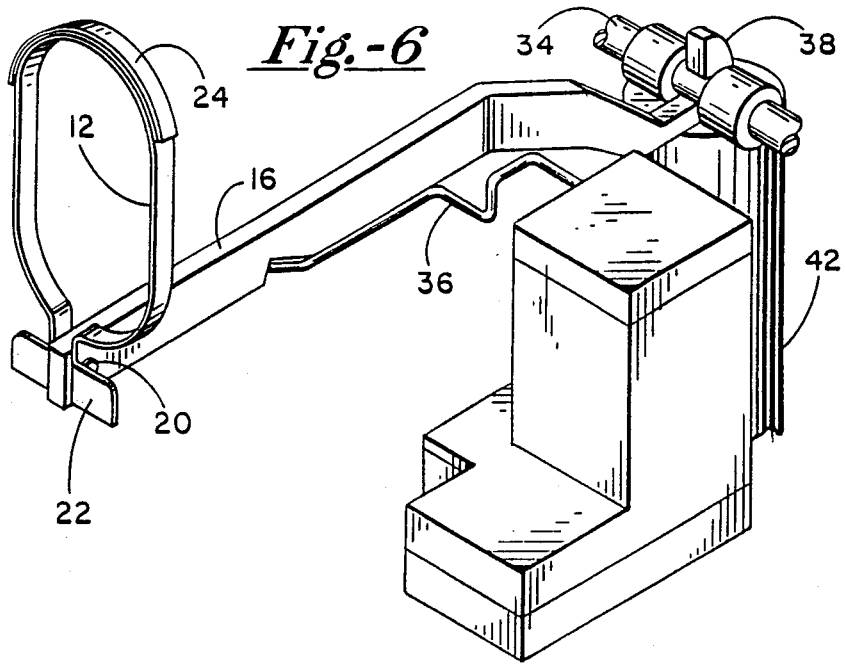
FIG. 6 is an isometric view showing the relationship of the pull ring, the bar, and the safety wire.
Figure 7:
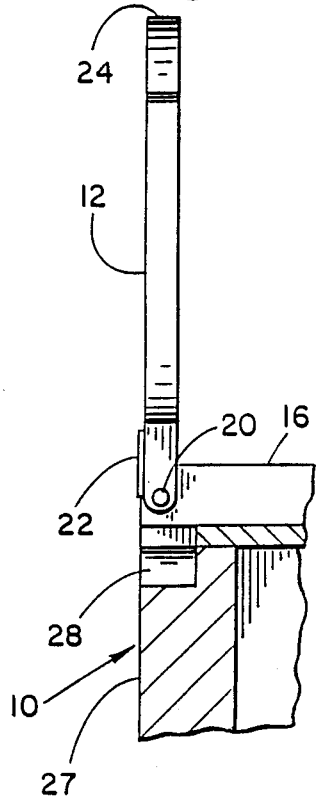
FIG. 7 is a detail showing the crosssection of the ring rotated 180 degrees from its recess.

In FIG. 5 ring 12 is shown rotated 180 degrees from the recessed position and since lugs 22 project from the inner edge of the ring in the recessed position the lugs are now in the outer plane of the ring after rotation. Lugs 22 now clear lug recess 28 and will not prevent moving ring 12 upward. This relationship is also shown in FIG. 7 where lugs 22 have been rotated to a position clear of lug recess 28 and lie outside of munition 10. If desired pin 20 could be located leftward closer to the left surface to permit lugs 22 clearing lug recess 28 before ring 12 is rotated 180 degrees. In FIG. 6 the orientation of ring 12 and bar 16 shown is the same as in FIG. 5 with integral lugs 22 rotated 180 degrees from the recessed position.

Figure 8:
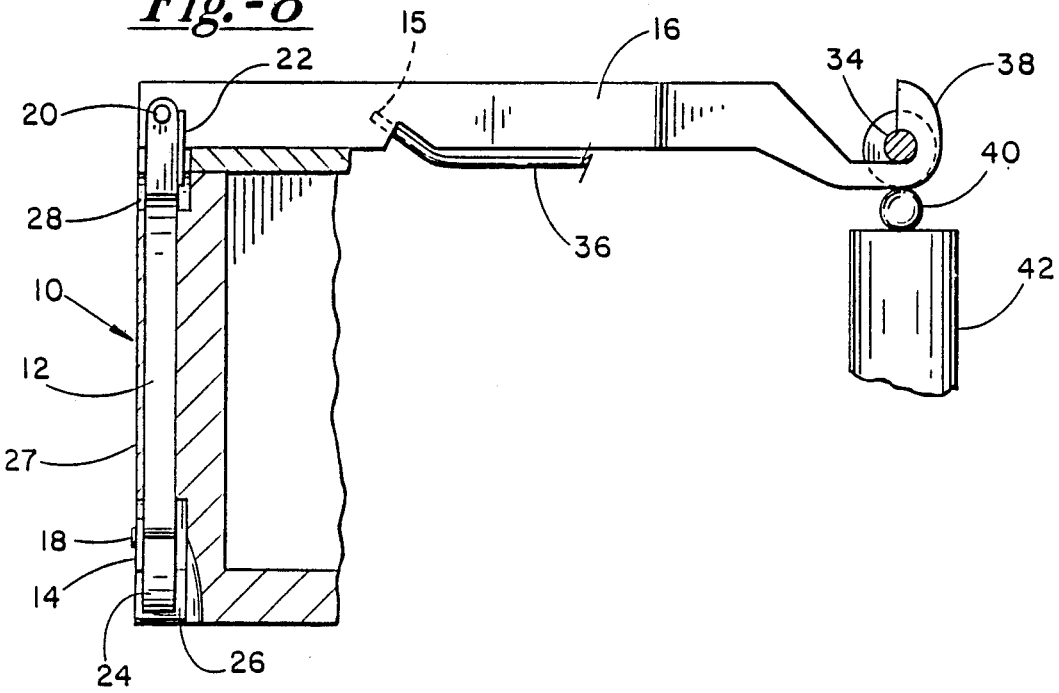
FIG. 8 is a cross-section of the ring, bar, safety wire, ball, battery and adjacent munition.
Figure 10:
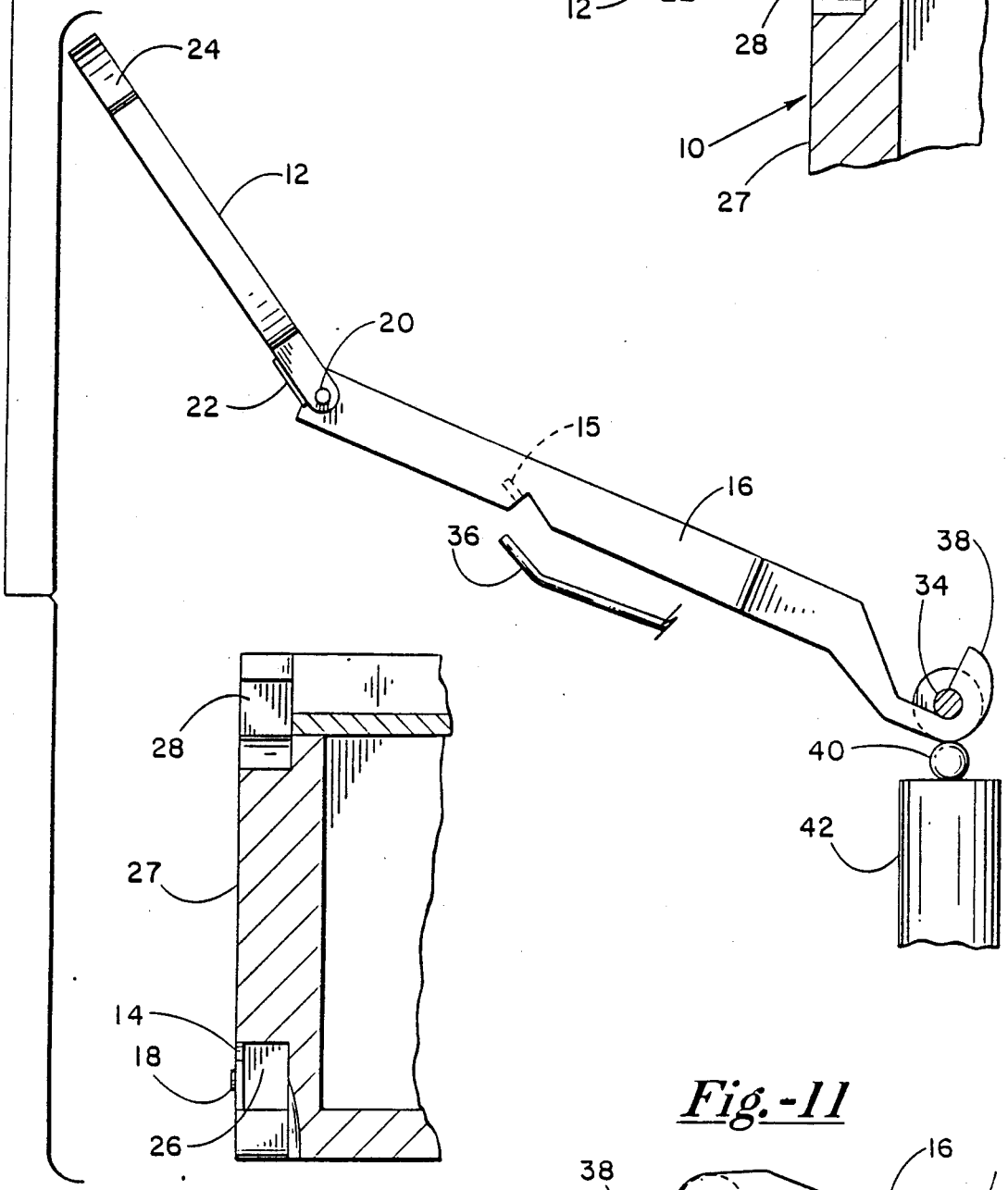
FIG. 10 is the view of FIG. 8 with ring released from the side of the munition and the bar partially rotated about the rod displacing a ball within the battery.
Figure 11:
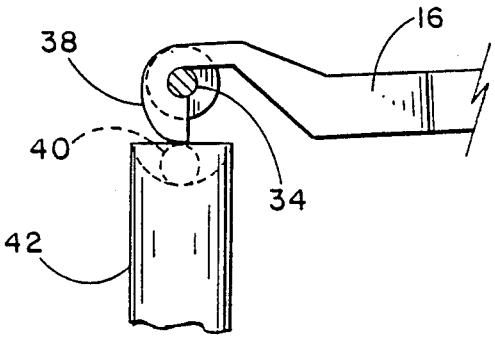
FIG. 11 is a detailed cross-section fragment showing the bar rotated 180 degrees and the battery depressed.

In FIG. 10 bar 16 is shown partially rotated about rod 34 by pulling upward on ring 12. As bar 16 is rotated safety wire 36 is freed from hole 15 in the bar because the pivot points for the safety wire and the bar are dissimilar. Rod 34 is secured to munition 10 into matching holes in the orientation shown in FIG. 12. An additional function of the multilayered portion of ring 24 is the under cross-section which will not cut the fingers when the ring is pulled on as a handle. Cam shaped end 38 of bar 16 is configured such that as bar 16 is rotated clockwise ball 40 is forced downward deforming battery 42. Safety wire 36 is also released by the clockwise rotation of bar 16. FIG. 6 shows safety wire 36 having a shorter lever ar than bar 16 but being bent to rotate in the same plane as the bar in a position under the bar. FIG. 8 shows safety wire 36 located within hole 15 when bar 16 is locked in place. Hole 15 is inclined within a notch such that the bent end of safety wire 36 can be readily engaged. FIG. 10 shows that as bar 16 is rotated about rod 34 safety wire 36 will pull free from hole 15 because of the different pivot axes. In FIG. 11 bar 16 is shown rotated 180 degrees from its secured position when recessed in the top of the munition. In this rotated position cam shaped end 38 has fully depressed ball 40 into battery 42. An ampule, not shown, located within battery 42 under ball 40 is fractured by this action and when fractured releases an electrolyte to provide electrical energy for the munition electronic circuitry.

Figure 12:
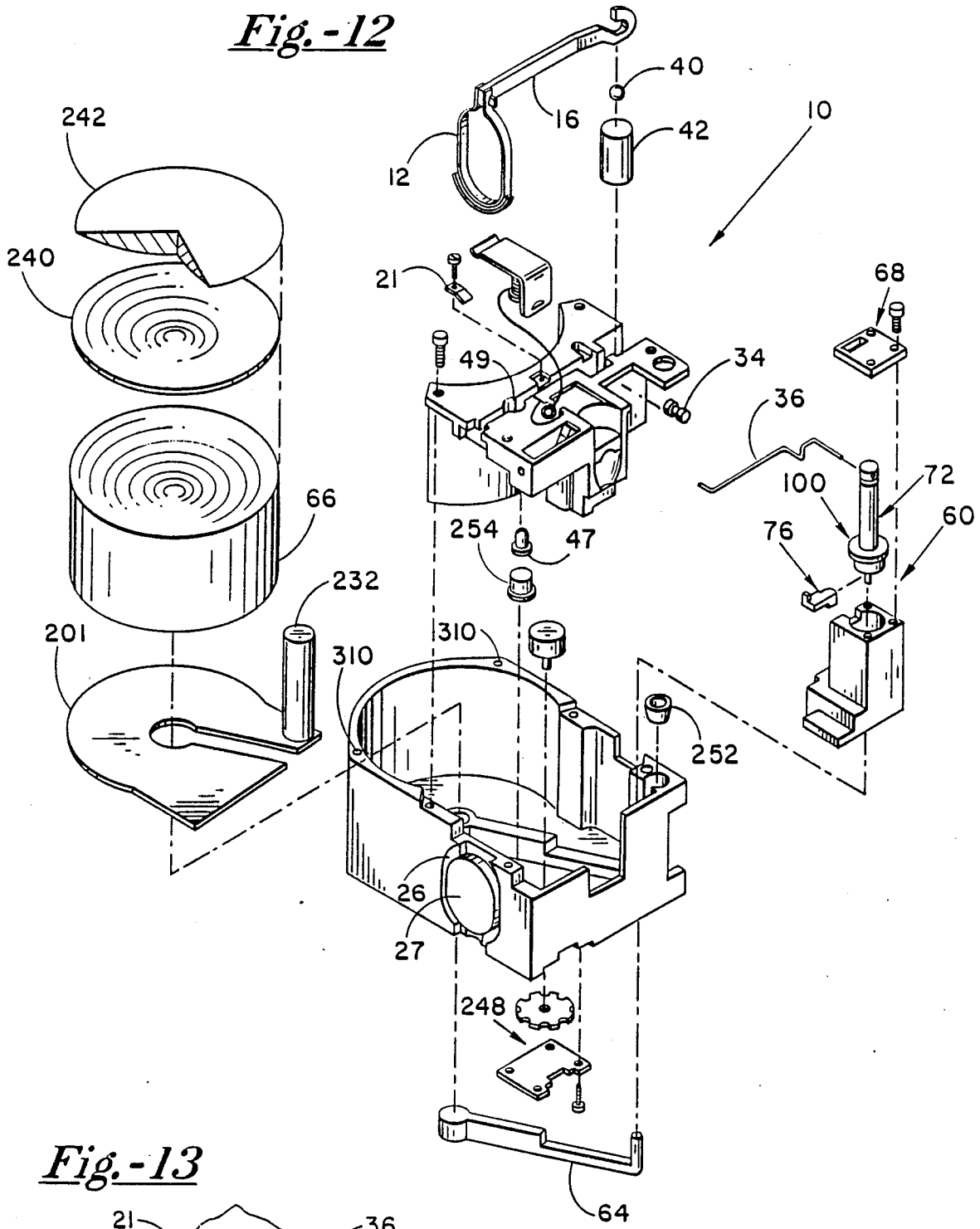
FIG. 12 is an exploded view of the munition.

In FIG. 12 the relationship between locking ring 12, bar 16, ring recess 26, rod 34, safety wire 36, ball 40, and battery 42 is shown. Safety wire 36 fits through a hole in a rotor 72 which prevents munition 10 from being armed. Indicator light 47 is visible through a hole 49 in bar slot 17 and is only exposed when bar 16 is rotated around rod 34 out of this slot.

Figure 13:
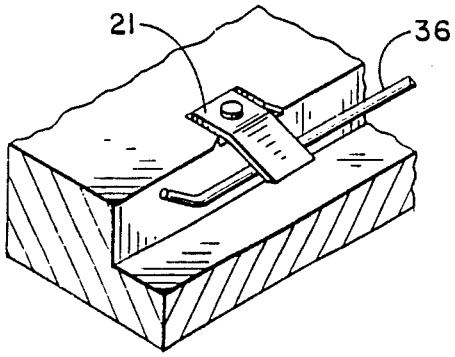
FIG. 13 is a detail of a groove segment, clip and safety wire.

The simple but multi-step procedure necessary to remove this safety, locking, pull ring 12 results in a safety device which is essentially impossible to remove accidentally. Not only must ring 12 be simultaneously deformed and rotated to be removed from ring recess 26 but it must then be rotated a full 180 degrees before locking lugs 22 are freed from lug recess 28 to release bar 16. Even then bar 16 must be rotated a considerable amount to remove safety wire 36 as a separate operation and a full 180 degrees to energize battery 42. While this sequence of events will not occur accidentially they are easy to perform intentionally. Simply deforming ring 12 with a finger or thumb while simultaneously lifting the ring will clear the ring from ring recess 28, then hooking a finger in the ring and rotating the ring 180 degrees and then rotating the bar 180 degrees will complete all remaining steps excepting only removing safety wire 36. Indicator light 47 is then observed to determine if the electronics are operating correctly before the now exposed safety wire 36 is removed to complete the arming process. Bar 16 is removed from rod 34 when rotated as shown in FIG. 11. If the indicator light 47 does not indicate that the munition should be armed then safety wire 36 is not removed but is pressed downward against clip 21 made of steel spring material into groove 17 which will deflect the clip and allow the safety wire to pass. Clip 21 will then spring back to secure safety wire in groove 17 as shown in FIG. 13. All of the items used here are simple mechanical items with reasonable tolerances and yet the result is a very secure safety mechanism.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. Apparatus for a portable munition comprising:

(a) a flexible planar ring having an outward projection, extending in the plane of said ring and in a direction generally perpendicular thereto; the projection having pivot means attached thereto having a pivot axis in the plane of said ring and perpendicular to the projection; said ring being constructed to have a predetermined unstressed shape and a predetermined stressed shape, when compressed along a line perpendicular to the pivot axis in the plane of said ring;

(b) a planar side surface on the munition having a ring recess which can contain said ring, the ring projection, and the pivot means, when said ring is oriented with a predetermined angular orientation with respect to and with the planar surface parallel to the side surface; said recess being sized to contain said ring whether in the stressed or the unstressed shape;

(c) first ring securing means for said ring, when contained within said ring recess, arranged such as to prevent the unstressed shape but permit the stressed shape ring to be rotated out of said ring recess about the pivot axis.

2. Apparatus as in claim 1 wherein said first ring securing means comprises at least one tab located in the plane of the side surface, and extending from a segment of the outside edge of the ring recess, which is generally opposite the portion containing the pivot means, partially over said ring recess.

3. Apparatus as in claim 1 wherein a segment of said ring recess, which is opposite the portion containing the pivot means, has a gap of the same depth which extends from the outer wall segment of said ring recess to the adjacent edge of the munition, arranged such that an operator can manually compress a ring contained in said ring recess to the stressed shape.

4. Apparatus as in claim 1 wherein said ring comprises a flat metal strip bent along the major axis with the projection, and wherein said projection comprising parallel portions of the metal strip fashioning said ring extending perpendicularly from the ends of said ring, and wherein said pivot means comprises a pin extending perpendicularly through the parallel portion of the metal strip.

5. Apparatus as in claim 1 wherein a portion of said ring generally opposite the pivot point is reinforced such that said stressed shape will change the least along that opposite portion to facilitate the release of said first ring securing means.

6. Apparatus as in claim 1 and further comprising second ring securing means for said ring arranged such that with said ring contained within said ring recess such that after said ring has been released from said first ring securing means, said ring cannot be moved along a path which is parallel to and with respect to the side surface and directed toward the pivot axis until said ring has been rotated to a predetermined angle with respect to said side surface.

7. Apparatus as in claim 6 wherein said second ring securing means comprises:

(a) a locking lug attached to the ring projection between the pivot means and said ring extending outwardly therefrom; and being in a plane parallel to said ring but offset therefrom, such that when said ring is contained in the ring recess the locking lug plane is adjacent to the bottom of the ring recess;

(b) the side surface having a locking lug recess interconnected with and having the same depth as said ring recess, being located and dimensioned such as to contain the locking lug, when said ring is contained in said ring recess; and arranged such that with said first ring securing means released, said ring can be rotated about the pivot means with the locking lug rotating within the lug recess but with a portion of the locking lug remaining within the lug recess to restrain the locking lug from moving in a plane parallel to the side surface directed toward the pivot axis, until said ring has been rotated a predetermined angle out of the ring recess about the pivot means.

8. Apparatus as in claim 9 and further comprising an indicator light mounted within said groove arranged to be exposed only after said bar is rotated out of said groove.

9. Apparatus as in claim 2 wherein:

(a) a planar top surface on the munition, being generally perpendicular to and having an abutting line with the side surface, and having a generally perpendicular groove which extends along a line perpendicular to the abutting line; with the ring recess in the side surface oriented and located such that, when said ring is located within said ring recess, the ring pivot axis will be parallel to and nearest the abutting line; and with the side surface, the top surface, said ring recess, said ring projection, the pivot means and said groove dimensioned and located such that said groove will extend into the end of said ring recess such as to bracket the pivot means;

(b) a rod secured transversely across and adjacent to the end of the groove opposite the ring recess, and oriented such as to have the longitudinal axis parallel to the top surface and perpendicular to the groove;

(c) a bar sized to fit within the groove and having a length such that a first end will extend into the ring recess to the pivot means, and an opposite second end will extend to said rod with the second end arranged to pivotably encircle said rod with a predetermined cam shape; and having the bar first end pivotably attached to the ring projection by the ring pivot means, such that with the first rod end so attached to said ring, said first and second ring securing means must be released in order to rotate said bar about said rod;

(d) a battery having a deformable outer wall and an inner ampule containing battery electrolyte, with the outer wall and capsule arranged such that the ampule will be broken by a predetermined deformation of the outer wall and release the battery electrolyte;

(e) the battery location and the predetermined cam shape dimensioned such that as said bar is rotated about the rod a predetermined angle from an initial position within the groove, said cam will bend the outer wall of the battery and cause the predetermined deformation necessary to break the ampule and release the battery electrolyte.

10. Apparatus as in claim 9 and further comprising:

(a) said bar, when located within said groove, having a safety wire hole located on the inside surface, said hole oriented to be within a plane perpendicular to said rod and inclined toward the second end of said rod;

(b) a safety wire being bent such that one end is pivotably attached to a portion of the munition having a pivot axis parallel to the rod but offset therefrom toward the opposite end of the groove, with the remainder of the safety wire bent along said bar such that, when said bar is located within the groove, will engage the safety wire hole.

11. Apparatus as in claim 10 and further comprising safety wire securing means arranged such that after said bar has been rotated from said groove, released the safety wire, and been removed from about the rod; the safety wire can then be rotated about its pivot axis into the groove and held therein by said safety wire securing means.

12. Apparatus as in claim 11 wherein said safety wire securing means comprises a spring-loaded clip mounted adjacent to, and angling into and partially across the groove; such that after said safety wire has been released from said bar and bar has been removed from said groove; said safety wire can be rotated about its pivot axis against and deflecting the clip to permit the safety wire to rotate past the clip; whereupon the clip will return to the original location and secure the safety wire in place.

* * * * *